US008133164B2

(12) United States Patent
Beebe et al.

(10) Patent No.: US 8,133,164 B2
(45) Date of Patent: Mar. 13, 2012

(54) TRANSPORTABLE SYSTEMS FOR TREATING DRILLING FLUID

(75) Inventors: Randy Charles Beebe, Beaumont (CA); Donald Tracey Crosswhite, Edmonton (CA); Larry Jona Kellert, Leduc (CA); James Joseph Tait, Leduc (CA); Dean Mitchell Bird, Calgary (CA)

(73) Assignee: National Oilwell Varco L.P., Houston, TX (US)

( * ) Notice: Subject to any disclaimer, the term of this patent is extended or adjusted under 35 U.S.C. 154(b) by 1095 days.

(21) Appl. No.: 12/008,980

(22) Filed: Jan. 14, 2008

(65) Prior Publication Data

US 2009/0178978 A1 Jul. 16, 2009

(51) Int. Cl.
*B04B 5/10* (2006.01)

(52) U.S. Cl. ..... 494/31; 494/42; 210/200

(58) Field of Classification Search ..... 494/31–32, 494/42; 210/521, 523, 533, 536, 200–202
See application file for complete search history.

(56) References Cited

U.S. PATENT DOCUMENTS

| | | | | | |
|---|---|---|---|---|---|
| 2,082,513 | A | | 6/1937 | Roberts | 210/76 |
| 2,112,784 | A | | 3/1938 | McNitt | 99/105 |
| 2,418,529 | A | | 4/1947 | Stern | 51/309 |
| 2,895,669 | A | * | 7/1959 | Bobo | 494/10 |
| 2,928,546 | A | * | 3/1960 | Church | 210/319 |
| 2,955,753 | A | * | 10/1960 | O'Conor et al. | 494/5 |
| 2,961,154 | A | * | 11/1960 | Bergey | 494/1 |
| 3,012,674 | A | | 12/1961 | Hoppe | 209/401 |
| 3,070,291 | A | * | 12/1962 | Bergey | 494/1 |
| 3,302,720 | A | | 2/1967 | Brandon | 166/42 |
| 3,640,344 | A | | 2/1972 | Brandon | 166/307 |
| 3,796,299 | A | | 3/1974 | Musschoot | 198/220 |
| 3,855,380 | A | | 12/1974 | Gordon et al. | 264/97 |
| 3,874,733 | A | | 4/1975 | Poundstone et al. | 299/17 |
| 3,900,393 | A | | 8/1975 | Wilson | 209/399 |
| 3,993,146 | A | | 11/1976 | Poundstone et al. | 175/206 |

(Continued)

FOREIGN PATENT DOCUMENTS

DE 4127929 A1 2/1993

(Continued)

OTHER PUBLICATIONS

U.S. Appl. No. 12/481,959 Final Office Action dated Oct. 27, 2010.

(Continued)

*Primary Examiner* — Charles E Cooley
(74) *Attorney, Agent, or Firm* — Williams, Morgan & Amerson, P.C.

(57) ABSTRACT

A system for well fluid treatment, the system being transportable, the system including a base, a support structure on the base, a brace apparatus connected to the base and to the support structure for bracing the support structure during movement of the system, the brace apparatus releasably secured to the support structure and releasably secured to the base, at least one holding tank on the base for holding well fluid to be treated, from an active rig well fluid system and the well fluid to be treated including solids, centrifuge apparatus for centrifuging a mixture of well fluid and solids from the at least one holding tank, producing reusable fluid, a first pump apparatus for pumping well fluid and solids from the at least one holding tank to the centrifuge apparatus, and a centrifuge support on the base for supporting the centrifuge apparatus.

16 Claims, 9 Drawing Sheets

U.S. PATENT DOCUMENTS

| | | | | |
|---|---|---|---|---|
| 4,033,865 | A | 7/1977 | Derrick, Jr. | 209/275 |
| 4,038,152 | A | 7/1977 | Atkins | 201/2.5 |
| 4,222,988 | A | 9/1980 | Barthel | 422/309 |
| 4,233,181 | A | 11/1980 | Goller et al. | 252/425.3 |
| 4,411,074 | A | 10/1983 | Daly | 34/32 |
| 4,474,254 | A | 10/1984 | Etter et al. | 175/206 |
| 4,482,459 | A | 11/1984 | Shiver | 210/639 |
| 4,526,687 | A | 7/1985 | Nugent | 210/202 |
| 4,536,286 | A * | 8/1985 | Nugent | 210/202 |
| 4,575,336 | A | 3/1986 | Mudd et al. | 432/72 |
| 4,595,422 | A | 6/1986 | Hill et al. | 134/19 |
| 4,624,417 | A | 11/1986 | Gangi | 241/17 |
| 4,650,687 | A | 3/1987 | Willard et al. | 426/438 |
| 4,696,353 | A | 9/1987 | Elmquist et al. | 175/206 |
| 4,696,751 | A | 9/1987 | Eifling | 210/780 |
| 4,729,548 | A | 3/1988 | Sullins | 266/44 |
| 4,751,887 | A | 6/1988 | Terry et al. | 110/246 |
| 4,770,711 | A | 9/1988 | Deal, III et al. | 134/18 |
| 4,774,007 | A | 9/1988 | Gordon | 210/766 |
| 4,783,057 | A | 11/1988 | Sullins | 266/44 |
| 4,791,002 | A | 12/1988 | Baker et al. | 426/641 |
| 4,799,987 | A | 1/1989 | Sullins | 156/425 |
| 4,809,791 | A | 3/1989 | Hayatdavoudi | 175/40 |
| 4,832,853 | A | 5/1989 | Shiraki et al. | 210/781 |
| 4,889,733 | A | 12/1989 | Willard et al. | 426/438 |
| 4,889,737 | A | 12/1989 | Willard et al. | 426/550 |
| 4,895,665 | A | 1/1990 | Colelli et al. | 210/710 |
| 4,895,731 | A | 1/1990 | Baker et al. | 426/641 |
| 4,896,835 | A | 1/1990 | Fahrenholz | 241/74 |
| 4,915,452 | A | 4/1990 | Dibble | 299/17 |
| 4,942,929 | A | 7/1990 | Malachosky et al. | 175/66 |
| 5,053,082 | A | 10/1991 | Flanigan et al. | 134/25.1 |
| 5,066,350 | A | 11/1991 | Sullins | 156/187 |
| 5,080,721 | A | 1/1992 | Flanigan et al. | 134/26 |
| 5,093,008 | A | 3/1992 | Cliford, III | 210/725 |
| 5,107,874 | A | 4/1992 | Flanigan et al. | 134/60 |
| 5,109,933 | A | 5/1992 | Jackson | 175/66 |
| 5,129,469 | A | 7/1992 | Jackson | 175/66 |
| 5,145,256 | A | 9/1992 | Wiemers et al. | 366/336 |
| 5,181,578 | A | 1/1993 | Lawler | 175/424 |
| 5,190,645 | A | 3/1993 | Burgess | 210/144 |
| 5,200,372 | A | 4/1993 | Kuroyama et al. | 501/96 |
| 5,221,008 | A | 6/1993 | Derrick, Jr. et al. | 209/269 |
| 5,227,057 | A | 7/1993 | Lundquist | 210/174 |
| 5,253,718 | A | 10/1993 | Lawler | 175/20 |
| 5,314,058 | A | 5/1994 | Graham | 198/753 |
| 5,337,966 | A | 8/1994 | Francis et al. | 241/46.06 |
| 5,385,669 | A | 1/1995 | Leone, Sr. | 210/488 |
| 5,422,012 | A | 6/1995 | Adams | 210/712 |
| 5,488,104 | A | 1/1996 | Schulz | 536/86 |
| 5,489,204 | A | 2/1996 | Conwell et al. | 432/153 |
| 5,494,584 | A * | 2/1996 | McLachlan et al. | 210/739 |
| 5,516,348 | A | 5/1996 | Conwell et al. | 51/309 |
| 5,534,207 | A | 7/1996 | Burrus | 264/150 |
| 5,547,479 | A | 8/1996 | Conwell et al. | 51/309 |
| 5,566,889 | A | 10/1996 | Preiss | 241/19 |
| 5,567,150 | A | 10/1996 | Conwell et al. | 432/14 |
| 5,570,749 | A | 11/1996 | Reed | 175/66 |
| 5,669,941 | A | 9/1997 | Peterson | 51/295 |
| 5,732,828 | A | 3/1998 | Littlefield, Jr. | 209/365.1 |
| 5,791,494 | A | 8/1998 | Meyer | 209/368 |
| 5,819,952 | A | 10/1998 | Cook et al. | 209/400 |
| 5,868,125 | A | 2/1999 | Maoujoud | 125/15 |
| 5,896,998 | A | 4/1999 | Bjorklund et al. | 209/326 |
| 5,944,197 | A | 8/1999 | Baltzer et al. | 209/400 |
| 5,971,307 | A | 10/1999 | Davenport | 241/259.1 |
| 6,013,158 | A | 1/2000 | Wootten | 202/99 |
| 6,045,070 | A | 4/2000 | Davenport | 241/60 |
| 6,059,977 | A | 5/2000 | Rowney et al. | 210/710 |
| 6,102,310 | A | 8/2000 | Davenport | 241/21 |
| 6,138,834 | A | 10/2000 | Southall | 209/17 |
| 6,155,428 | A | 12/2000 | Bailey et al. | 209/315 |
| 6,170,580 | B1 | 1/2001 | Reddoch | 175/66 |
| 6,193,070 | B1 | 2/2001 | Rowney et al. | 209/5 |
| 6,223,906 | B1 | 5/2001 | Williams | 210/400 |
| 6,234,250 | B1 | 5/2001 | Green et al. | 166/250.03 |
| 6,279,471 | B1 | 8/2001 | Reddoch | 100/37 |
| 6,283,302 | B1 | 9/2001 | Schulte et al. | 209/399 |
| 6,333,700 | B1 | 12/2001 | Thomeer et al. | 340/854.8 |
| 6,391,195 | B1 | 5/2002 | Layton | 210/195.1 |
| 6,506,310 | B2 | 1/2003 | Kulbeth | 210/780 |
| 6,763,605 | B2 | 7/2004 | Reddoch | 34/58 |
| 6,783,088 | B1 | 8/2004 | Gillis et al. | 241/19 |
| 6,793,814 | B2 | 9/2004 | Fout et al. | 210/188 |
| 6,808,626 | B2 | 10/2004 | Kulbeth | 210/241 |
| 6,855,261 | B2 | 2/2005 | Boulte et al. | 210/768 |
| 6,863,809 | B2 * | 3/2005 | Smith et al. | 210/202 |
| 6,881,349 | B2 | 4/2005 | Mueller | 210/708 |
| 6,926,101 | B2 * | 8/2005 | deBoer | 175/70 |
| 7,022,240 | B2 | 4/2006 | Hart et al. | 210/712 |
| 7,144,516 | B2 * | 12/2006 | Smith | 210/803 |
| 7,195,084 | B2 | 3/2007 | Burnett et al. | 175/66 |
| 7,284,665 | B2 | 10/2007 | Fuchs | 209/270 |
| 7,296,640 | B2 | 11/2007 | Tettleton | 175/66 |
| 7,303,079 | B2 | 12/2007 | Reid-Robertson et al. | 209/405 |
| 7,316,321 | B2 | 1/2008 | Robertson et al. | 209/400 |
| 7,373,996 | B1 | 5/2008 | Martin et al. | 175/206 |
| 7,484,574 | B2 | 2/2009 | Burnett et al. | 175/66 |
| 7,503,406 | B2 | 3/2009 | Seaton et al. | 175/66 |
| 7,507,344 | B2 | 3/2009 | Mueller | 210/708 |
| 7,514,011 | B2 | 4/2009 | Kulbeth | 210/780 |
| 7,540,837 | B2 * | 6/2009 | Scott et al. | 494/7 |
| 7,540,838 | B2 * | 6/2009 | Scott et al. | 494/7 |
| 7,581,569 | B2 | 9/2009 | Beck | 139/425 R |
| 7,770,665 | B2 | 8/2010 | Eia et al. | 175/66 |
| 2001/0032815 | A1 | 10/2001 | Adams et al. | 210/388 |
| 2002/0000399 | A1 | 1/2002 | Winkler et al. | 209/399 |
| 2002/0033278 | A1 | 3/2002 | Reddoch | 175/57 |
| 2002/0134709 | A1 | 9/2002 | Riddle | 209/238 |
| 2004/0040746 | A1 | 3/2004 | Niedermayr et al. | 175/38 |
| 2004/0051650 | A1 | 3/2004 | Gonsoulin et al. | 340/853.1 |
| 2004/0156920 | A1 | 8/2004 | Kane | 424/725 |
| 2004/0245155 | A1 | 12/2004 | Strong et al. | 209/405 |
| 2005/0236305 | A1 | 10/2005 | Schulte, Jr. et al. | 209/403 |
| 2006/0019812 | A1 * | 1/2006 | Stalwick | 494/42 |
| 2006/0034988 | A1 | 2/2006 | Bresnahan et al. | 426/502 |
| 2006/0105896 | A1 * | 5/2006 | Smith et al. | 494/7 |
| 2008/0078704 | A1 | 4/2008 | Carr et al. | 209/399 |
| 2008/0179090 | A1 | 7/2008 | Eia et al. | 175/5 |
| 2008/0179096 | A1 | 7/2008 | Eia et al. | 175/66 |
| 2008/0179097 | A1 | 7/2008 | Eia et al. | 175/66 |
| 2009/0178978 | A1 * | 7/2009 | Beebe et al. | 210/747 |
| 2009/0286098 | A1 | 11/2009 | Yajima et al. | 428/507 |
| 2009/0316084 | A1 | 12/2009 | Yajima et al. | 349/96 |
| 2010/0084190 | A1 | 4/2010 | Eia et al. | 175/5 |
| 2010/0119570 | A1 | 5/2010 | Potter et al. | 424/422 |

FOREIGN PATENT DOCUMENTS

| | | |
|---|---|---|
| FR | 2 611 559 | 9/1988 |
| FR | 2 636 669 | 3/1990 |
| GB | 2 030 482 A | 4/1980 |
| GB | 2 327 442 A | 1/1999 |
| JP | 55112761 | 8/1980 |
| JP | 59069268 | 4/1984 |
| JP | 63003090 | 1/1988 |
| JP | 63283860 | 11/1988 |
| JP | 63290705 | 11/1988 |
| JP | 02127030 | 5/1990 |
| JP | 02167834 | 6/1990 |
| JP | 03240925 | 10/1991 |
| JP | 03264263 | 11/1991 |
| JP | 04093045 | 3/1992 |
| JP | 04269170 | 9/1992 |
| JP | 05043884 | 2/1993 |
| JP | 05301158 | 11/1993 |
| JP | 06063499 | 3/1994 |
| JP | 07304028 | 11/1995 |
| JP | 08039428 | 2/1996 |
| JP | 08270355 | 10/1996 |
| JP | 09109032 | 4/1997 |
| WO | WO98/10895 | 3/1998 |

OTHER PUBLICATIONS

U.S. Appl. No. 12/481,959 Office Action dated Jun. 7, 2010.
U.S. Appl. No. 12/469,851 Final Office Action dated Nov. 9, 2010.
U.S. Appl. No. 12/469,851 Office Action dated Jun. 28, 2010.

U.S. Appl. No. 12/227,462 Office Action dated Nov. 15, 2010.
U.S. Appl. No. 11/897,976 Final Office Action dated Sep. 1, 2010.
U.S. Appl. No. 11/897,976 Office Action dated Apr. 1, 2010.
U.S. Appl. No. 11/897,975 Final Office Action dated Jul. 21, 2010.
U.S. Appl. No. 11/897,975 Office Action dated Feb. 19, 2010.
U.S. Appl. No. 11/637,615 Final Office Action dated Aug. 2, 2010.
U.S. Appl. No. 11/637,615 Office Action dated Mar. 2, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL:http://web.archive.org/web/20051123025735/http://www.azom.com/details.asp?ArticleID=493>.

* cited by examiner

TRANSPORTABLE SYSTEMS FOR TREATING DRILLING FLUID

BACKGROUND OF THE INVENTION

1. Field of the Invention

The present invention is directed to on-site treatment of drilling fluids, mobile systems for treating drilling fluids, methods of their use, and, in certain particular aspects, to such systems and methods that have erectable parts to facilitate fluid processing.

2. Description of Related Art

The prior art discloses a wide variety of systems for treating drilling fluids and methods of their use; for example, and not by way of limitation, see the systems and methods in U.S. Pat. Nos. 7,296,640; 7,022,240; 6,881,349; 6,863,809; 6,808,626; 6,855,261; 6,391,195; 6,193,070; 6,059,977; 5,093,008; 4,595,422; 4,536,286; and 4,474,254—all of said patents incorporated fully herein for all purposes.

Oil and gas well exploration involves the generation of various fluids and of waste products, including, e.g., fluid wastes, spent drilling fluids, and fracture or return fluids from various operations. Fluids, etc. have been treated and processed both on-site and off-site. U.S. Pat. No. 4,465,598 discloses an off-site method for the precipitation of metals including iron, nickel, chromium, cobalt, and manganese in oil and gas well heavy brines which have been filtered initially to remove solids. U.S. Pat. No. 4,634,533 discloses an oil and gas well brine treatment including an initial oxidizing treatment to convert iron to the ferric state. U.S. Pat. No. 5,814,230 describes an apparatus and method for separation of solids from liquid for use with different processes and describes the separation of solids from a liquid flow using an endless conveyor carrying screen filters which dredge gravity-settled solids from the bottom of a settling tank and filter solids suspended in the flowing liquid. The solids are further dewatered while on the filters using a combination of vibration and air streams. U.S. Pat. No. 4,436,635 describes a filtering process for filtration of oil and gas well treatment fluids.

Treating fluids, etc., off-site can be uneconomical due to transportation costs. Consequently mobile systems for on-site treatment have been developed, some of which attempt to produce fluid re-usable on-site. U.S. Pat. No. 4,895,665 discloses on-site methods for treating and reclaiming oil and gas well working fluids and the related drilling pits and methods of chemical treatment and filtration of oil and gas well working fluids within associated drilling pits. These methods include preparing a drilling pit for closure through reduction of the fluid content in sludge which is formed in the drilling pit. Treated water can be reused.

U.S. Pat. No. 5,093,008 describes on-site processes and apparatus for recovering reusable water from waste drilling fluid. The processes involve a dewatering process and apparatus for concurrent reutilization of water in waste drilling fluids from an active drilling operation that includes a storage area, an intermixer for introducing treatment chemicals into the waste drilling fluids, and a centrifuge. Flocculation is chemically induced in the waste drilling fluids as they pass through the intermixing needs for introducing treatment chemicals into the waste drilling fluids. The waste drilling fluids are then transferred to a centrifuge where solid waste is separated from clear, reusable water. The water is returned to the storage area and may be chemically adjusted prior to being returned to the drilling rig.

U.S. Pat. No. 4,536,286 describes a self-contained, portable waste treatment system for hazardous and non-hazardous waste with a pair of mixing tanks. Solids are removed from fluid waste streams by flocculation and related solids deposition.

U.S. Pat. No. 7,022,240 discloses an apparatus and method for on-site treatment and reclamation of oil and gas well waste water or fracturing fluids. The mobile treatment process and apparatus provide both chemical precipitation and filtration to treat the drilling fluid waste to a technically and environmentally acceptable level allowing for reuse. Alkaline treating agents are applied to the drilling waste fluids, as they are pumped through the treatment apparatus, to increase the pH of the fluid waste to a preferred pH range and to also cause selective soluble contaminants in the fluids to form a precipitate. The waste fluid is allowed to clarify as the precipitate of insoluble contaminants, through flocculation, settle and form a sludge at the bottom of the drilling pit. The clarified fluids are then filtered to satisfy applicable industry and environmental requirements.

Single skid mounted apparatus for providing all the components necessary to treat used drilling mud and return a clarified liquid for reuse in an active mud system are disclosed in prior references; e.g., see U.S. Pat. Nos. 4,536,286; 4,474,254; 5,582,727; 6,391,195; and 6,863,809. For example, U.S. Pat. No. 4,536,286 discloses a transportable waste treatment which is completely mobile and capable of treating high mud volumes. This system is self-contained having chemical storage, chemical pumps, sludge pumps, water pumps, laboratory, centrifuge, conveyors etc. and has weight, height and width suitable for highway travel. A skid incorporates three settling tanks and two chemical tanks for flocculation. Waste liquids containing solids enter a first settling tank and are mixed with flocculation chemicals. Solids settle to the tapered bottom of the tank for collection by a suction located at the apex of the tank bottom. Partially clarified liquid from the first settling tank overflows a weir to the next adjacent settling tank and similarly for the second to the third settling tank.

U.S. Pat. No. 5,582,727 discloses a single structural skid with four settling tanks, each equipped with a shaker and a de-silter. Used drilling mud is routed sequentially from tank to tank. Partially clarified liquid is decanted over weirs to each tank in succession. Fixed suction pumps extract settled solids from the bottom of each tank and route them to the de-silter of each additional and successive tank. Foster does not practice flocculation.

U.S. Pat. No. 6,391,195 discloses an apparatus for cleaning clearwater drilling muds and a process for treating used drilling mud, particularly that produced during clearwater drilling. A structural and highway transportable skid has two or more settling tanks connected in succession. Flocculation aids settling of solids to the bottom and clarified liquid forms at the surface. Clarified liquid flows from one tank to the next successive tank. Clarified liquid is produced from the last of the successive settling tanks. The tanks have flat bottoms. Passageways extend between each successive tank for gravity-flowing liquid from one tank to successive settling tank. A solids tank or centrifuge is also mounted within the skid. The solids and settling tanks are located for weight-balancing. A rotational suction is positioned in the bottom of each settling tank and having one or more radially extending conduits which rotate about an axis and have inlets at their distal ends which traverse an inscribed circular path about the periphery of the tank's bottom. Collected solids are directed to the solids tank and a drag conveyor transporting solids product outside the skid.

There has long been a need, recognized by the present inventors, for effective and efficient systems for on-site treatment and processing of well fluids. There has long been a need, recognized by the present inventors, for effective and efficient unitized skid-mounted systems for processing well fluids with centrifuge apparatus.

U.S. Pat. No. 6,863,809 discloses transportable drilling fluid cleaning systems for removing solids from drilling fluid at a drill site comprises a platform for transporting the system. A bin region on the platform retains solids from the drilling fluid. A settling tank on the platform separates the drilling fluid into an upper fluid fraction having a reduced concentration of solids and a lower solids fraction having a higher concentration of solids as the drilling fluid flows from an inlet chamber for receiving drilling fluid to at least one other chamber. A stand on the platform supports at least one centrifuge for separating the solids from the drilling fluid, the stand being movable between stored and operating positions. The system provides a self-contained unit that is easily transportable on a flat bed truck to provide all the ancillary equipment necessary for solids control at the drill site. In certain aspects such systems include: a platform for transporting the cleaning system to a drill site; a bin region on the platform to retain solids from the drilling fluid; a settling tank on the platform having an inlet chamber to receive drilling fluid and at least one other chamber, the settling tank acting to separate the drilling fluids into an upper fluid fraction having a reduced concentration of solids and a lower solids fraction having a higher concentration of solids as the drilling fluid flows from the inlet chamber to at least one other chamber; and a stand on the platform to support at least one centrifuge for separating the solids from the drilling fluid, the stand being movable between a stored position during transport of the platform and an operating position. In certain of these systems, the platform is skid loadable onto a trailer towable by a vehicle to move the system as a unit.

BRIEF SUMMARY OF THE PRESENT INVENTION

The present invention discloses, in certain aspects, systems for treating well fluids which are easily transportable; which include erection apparatus for raising system components to facilitate their positioning and operation; and which include removable bracing structures for transport.

In certain aspects, such systems require no auger apparatus to move material. In certain aspects, such systems employ at least one or one or more cone-bottom tanks with a feed well from which top fluid is skimmed to an adjacent tank via a baffle. The conical bottom converges and concentrates solids for removal or for feed to one, two, or more centrifuges for further processing. In certain particular aspects, using such cone tanks, barite recovery is enhanced since there is one primary suction area or point within the tank. This is also beneficial in oil-based mud solids reduction (stripping) operations to concentrate solids. In such systems, optional agitation enhances chemical and solids/fluid blending and inhibits the accumulation and the undesirable build up of solids on the tank bottoms.

In certain aspects, systems according to the present invention include raising apparatus for raising a centrifuge support with one or more centrifuges thereon. The centrifuge support has multi-part telescoping vertical legs and the raising apparatus raises the centrifuge support up vertically as the legs telescope out vertically.

In certain aspects, such systems require relatively less space than certain prior systems. In certain aspects systems according to the present invention weigh about 53,000 pounds, including a centrifuge and can fit on a 43 foot long skid; whereas certain prior systems weigh about 57,000 pounds without a centrifuge.

Accordingly, the present invention includes features and advantages which are believed to enable it to advance drilling fluid treatment technology. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious transportable systems and methods of their use for on-site treatment of well fluids, including drilling fluids and spent drilling fluids with drilled cuttings;

Such systems and methods with erection apparatus for raising system components vertically to facilitate their positioning and operation; and Such systems and methods with the system parts braced with releasable bracing apparatus for stability during movement of the system, e.g. during transport to a remote site.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

Figure 1A:
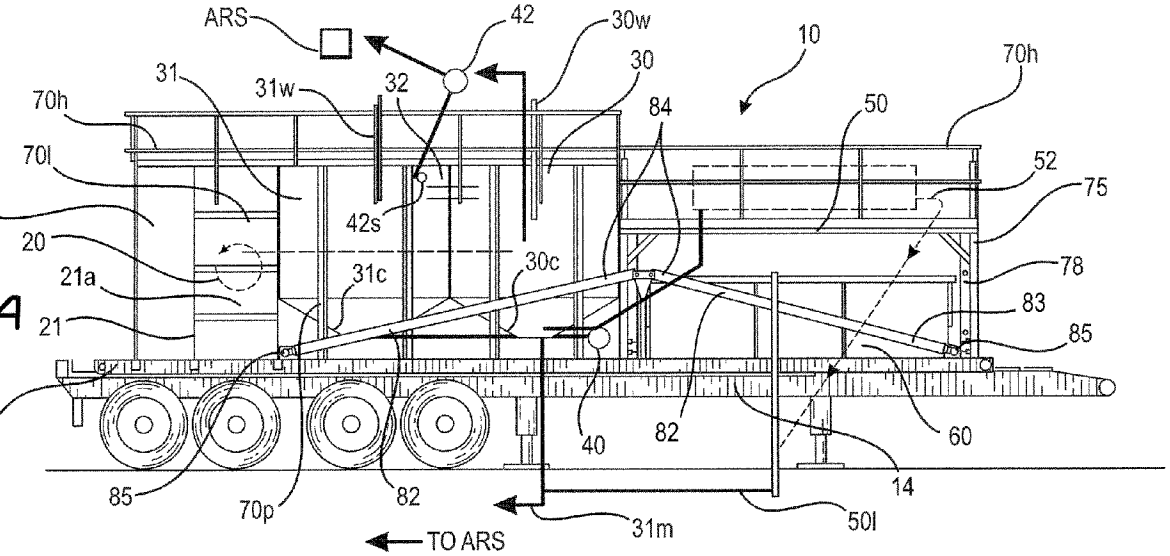
FIG. 1A is a side view of a system according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein. No feature, aspect, step or element is critical or essential to the invention unless it is specifically referred to herein as "critical" or "essential."

DETAILED DESCRIPTION OF THE INVENTION

Figure 1B:
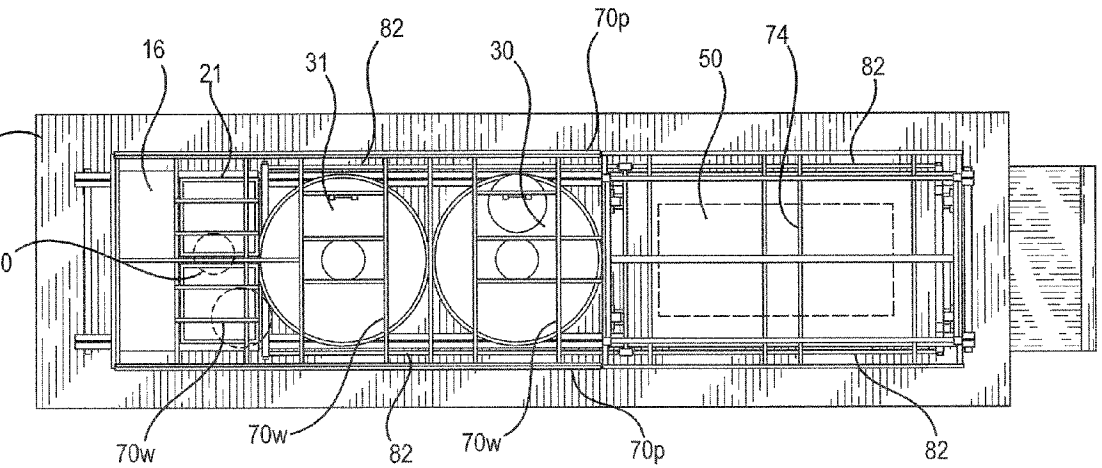
FIG. 1B is a top view of the system of FIG. 1A.
Figure 1C:
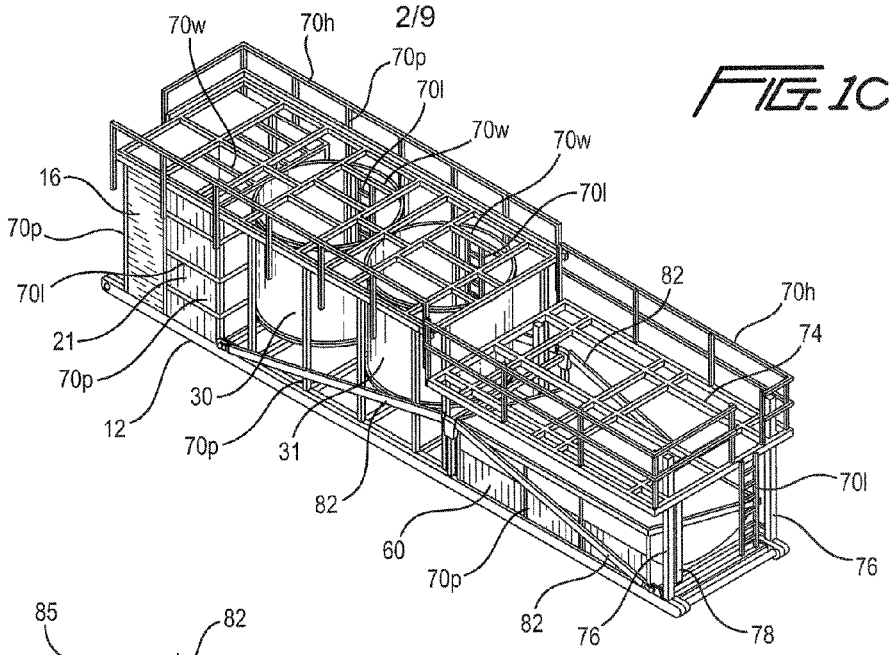
FIG. 1C is a perspective view of part of the system of FIG. 1A.
Figure 3:
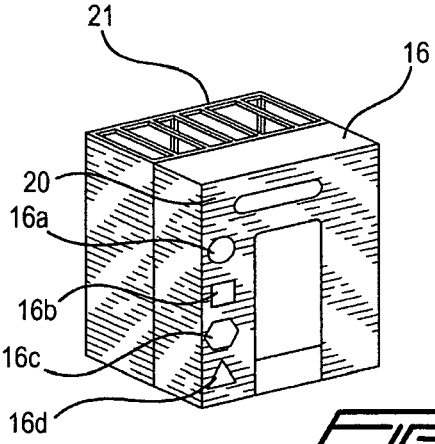
FIG. 3 is a perspective view of part of the system of FIG. 1A.
Figure 4:
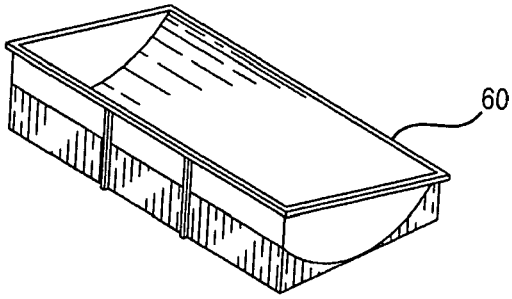
FIG. 4 is a perspective view of a shale tank of the system of FIG. 1A.

FIGS. 1A and 1B illustrate a system 10 according to the present invention which has a base which is a skid 12 removably positioned on a trailer 14. Fluid to be treated 30*w* (including, but not limited to, spent drilling fluid with drilled cuttings and/or solids therein) is pumped from an active rig system ARS to a first holding tank 30. A pump 42 pumps fluid from a tank 31 to an active rig pumping system ARS. Flocculant and coagulant is mixed in aqueous solution in the tank 21 with an agitator or impeller 21*a* (shown schematically) in the tank. The coagulant, e.g. but not limited to calcium nitrate—CaNO.sub.3, makes the fluid more of a fluidic semi-solid mixture. A pump or pumps 20 (shown schematically) in a doghouse enclosure 16 pump the fluid-flocculant mixture from the tank 21 to the first holding tank 30; and, optionally, to a centrifuge or centrifuges as described below in detail. The doghouse enclosure 16 may also have: pumps for the flocculant mixture 16*a*; impeller controls 16*b*; hydraulic controls 16*c* for power apparatus 78; and/or a heater 16*d* (see, FIG. 3). Solids that settle down in the tank 30 are pumped by the pump 40 (shown schematically) to a centrifuge 50 (shown schematically, FIGS. 1A, 1B). Water from the upper part of the tank 30 overflows via water flow apparatus, a baffle 32, to the tank 31. Relatively clean water from a feed well 31*w* is pumped by the pump 42, e.g. to storage or to the active rig system ARS. Any desired number of tanks like the tanks 30 and/or 31 may be used.

A sensor system 42*s* signals the pump 42 to control the amount of water sent to the rig system ARS. Solids with some fluid from the lower part of the tank 31 (and from lower the part of the tank 30) are pumped by the pump 40 to the centrifuge 50 (one or two or more centrifuges 50 may be used). Relatively clean water from the upper part of the tank 30 flows via the baffle 32 to the tank 31 and is then pumped to the active rig system ARS by the pump 42. Fluid (including water and some drilling fluid) with solids in it is pumped by the pump 40 to the centrifuge 50. In one aspect the tanks 30 and 31 have conical bottoms 30*c* and 31*c*, respectively, to facilitate solids movement and flow.

Centrifuge underflow (drilled solids separated in the centrifuge by centrifugal force) flows from the centrifuge 50 down into a tank 60. This underflow is then transferred to a holding tank or pit for storage and/or further treatment.

The system 10 includes a structure 70 with a plurality of interconnected beams, members, bars, supports and pieces 70*p*. Some of these pieces 70*p* form upper walkways 70*w* and hand rails 70*h*.

Figure 1D:
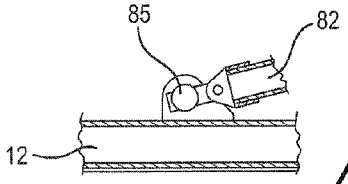
FIG. 1D is a side view of part of the system of FIG. 1A.
Figure 1E:
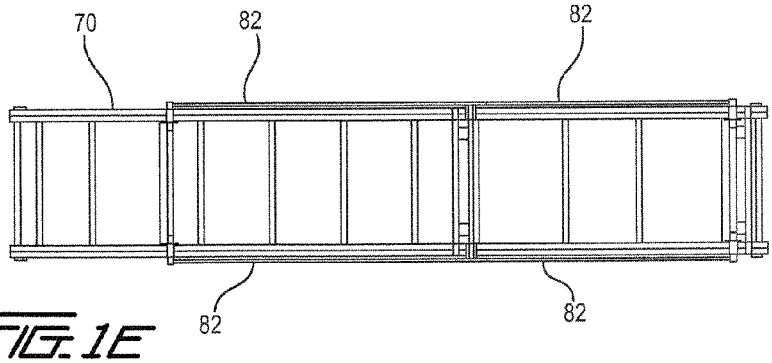
FIG. 1E is a top view of part of the system of FIG. 1A.
Figure 1F:
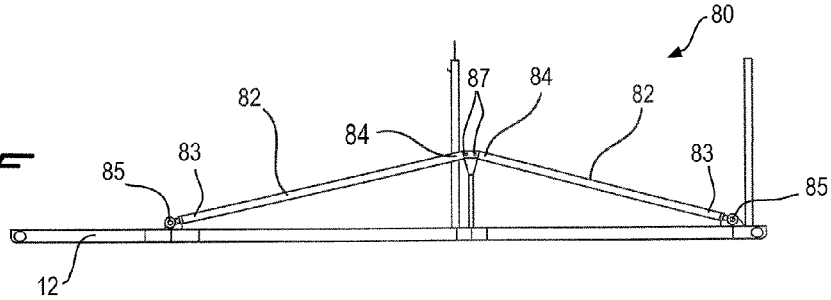
FIG. 1F is a side view of part of the system of FIG. 1A.

To buttress the system 10 and the structure 70 during transport and movement, a removable brace apparatus 80 is releasably connected to the structure 70 and to the skid 12. The apparatus 80 includes four beams 82 each with an end 83 releasably connected to the skid 12 and with another end 84 releasably connected to the structure 70. As shown in FIGS. 1D and 1F a removable pin 85 releasably secures an end 83 to the skid 12. Pins 87 releasably secure the ends 84 to the structure 70. The pins are removed and the beams 82 are removed following positioning of the system at a site. Four beams 82 are shown, but two, three, five, six or more can be used. The beams 82 do not prevent erection of the centrifuge support 74 described below.

Figure 1G:
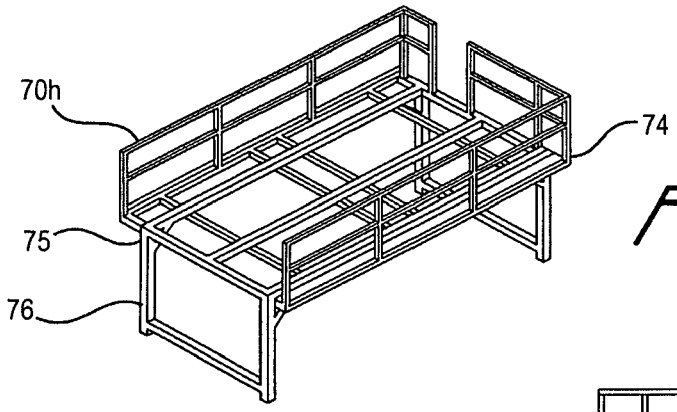
FIG. 1G is a perspective view of part of the system of FIG. 1A.

As shown in FIG. 1G the structure 70 includes a centrifuge support 74 with legs 75 and 76. A power apparatus 78 (e.g. an hydraulic piston apparatus powered by an available hydraulic power unit 78*h*, shown schematically, FIG. 1I) can raise the centrifuge support 74 up vertically with respect to lower legs 76 of the structure 70. FIG. 1I shows the legs 75 raised with respect to the legs 76. The legs 75 telescope out of and up from the legs 76.

Figure 1H:
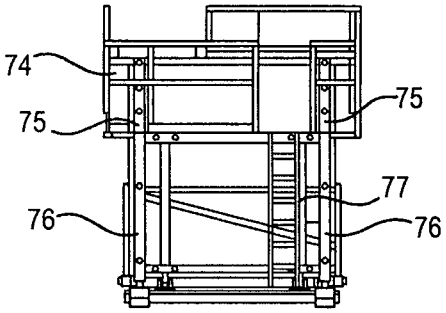
FIG. 1H is an end view of the system of FIG. 1A.
Figure 1I:
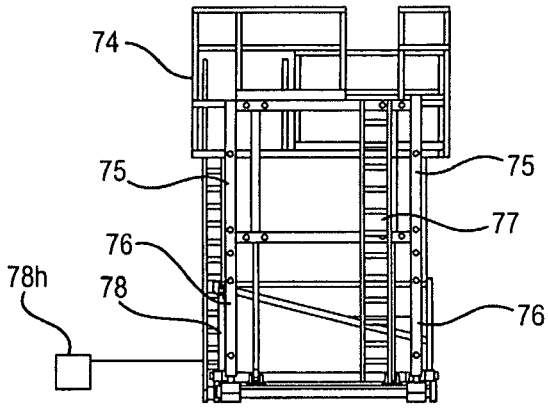
FIG. 1I is an end view of the system of FIG. 1A with part of the system raised.
Figure 2:
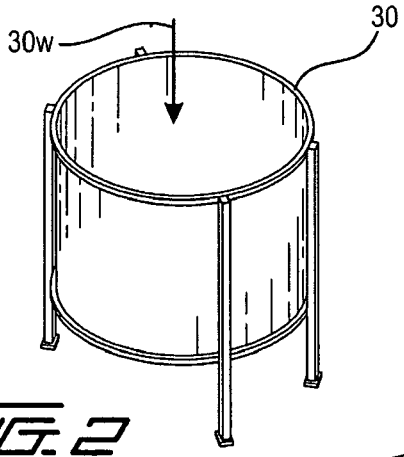
FIG. 2 is a perspective view of a tank of the system of FIG. 1A.

FIG. 1H shows the centrifuge support 74 in a lowered position and FIG. 1I shows it in a raised position. An extension ladder 77 extends upwardly as the centrifuge support 74 is raised.

The centrifuge 50 produces the underflow described above and a stream 52 of clean drilling fluid which can be fed into a line 50*l* by gravity flow to the line 31*m* for return to the active rig system ARS.

The tanks 30, 31 are shown as "cone" tanks with a bottom shaped to converge solids; but it is within the scope of other aspects of the present invention to use other tanks, e.g. with non-conical bottoms or with flat bottoms.

Figure 1J:
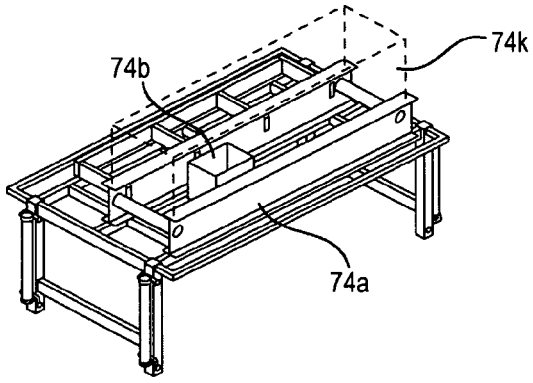
FIG. 1J is a perspective view of part of a centrifuge support according to the present invention.
Figure 1K:
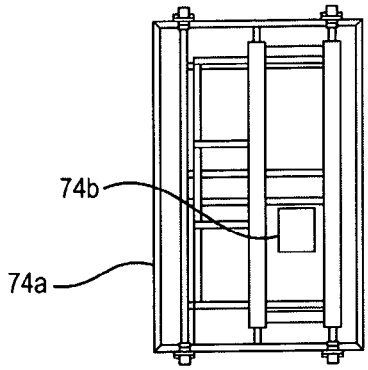
FIG. 1K is a top view of the support of FIG. 1J.
Figure 1L:
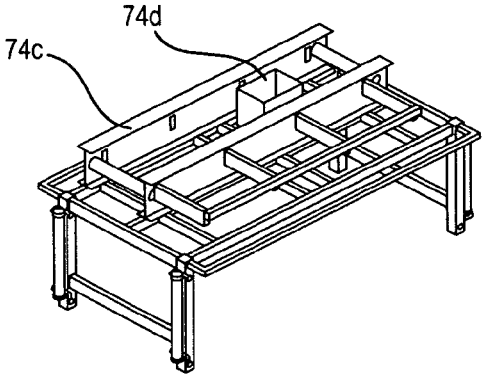
FIG. 1L is a perspective view of part of a centrifuge support according to the present invention.
Figure 1M:
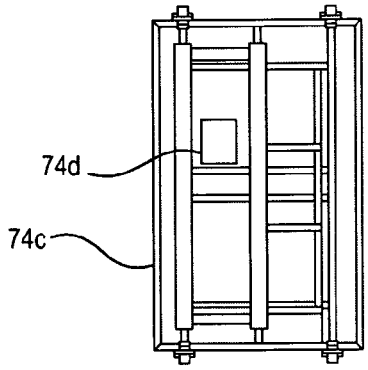
FIG. 1M is a top view of the support of FIG. 1L.
Figure 1N:
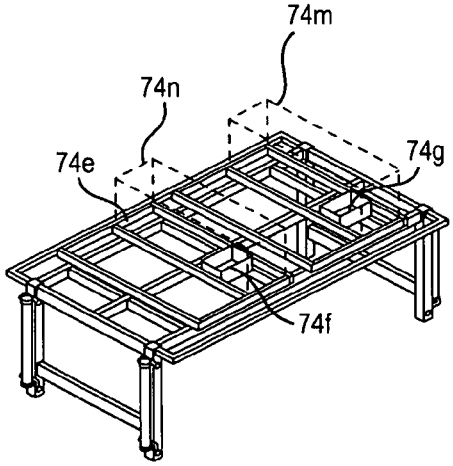
FIG. 1N is a perspective view of part of a centrifuge support according to the present invention.
Figure 1O:
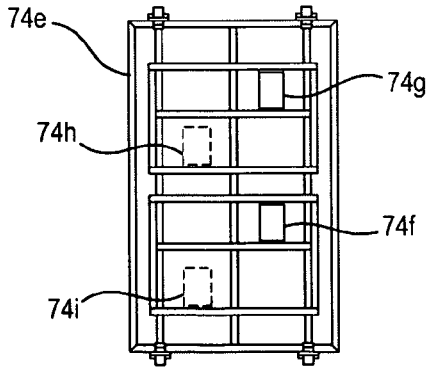
FIG. 1O is a top view of the support of FIG. 1L.

FIGS. 1J-1O illustrate various possibilities according to the present invention for solids discharge from one or two centrifuges on a support 74. FIGS. 1J and 1K show a support 74*a* for one centrifuge 74*k* (shown schematically in dotted lines) with a single solids discharge channel 74*b*. FIGS. 1L and 1M show a support 74*c* with a single solids discharge channel 74*d*. FIGS. 1N and 1O show a support 74*e* with two solids discharge channels 74*f*, 74*g* for centrifuges 74*m*, 74*n* (in dotted lines) (or alternatively, 74*h*, 74*i*—shown in dotted lines). Any two discharges shown in FIG. 1O may be used.

In certain particular aspects the overall footprint of a system according to the present invention is 42 feet by 8 feet and the footprint of one particular old system is 40 feet by 32 feet.

Figure 5A:
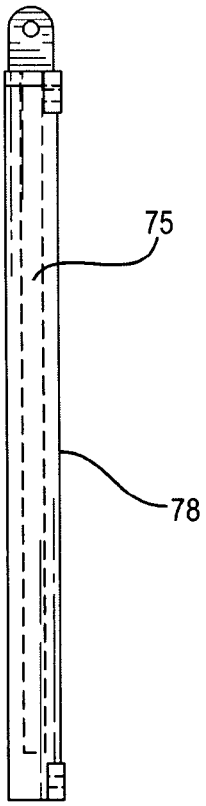
FIG. 5A is a side view of a power apparatus for raising a centrifuge support of the system of FIG. 1A.
Figure 5B:
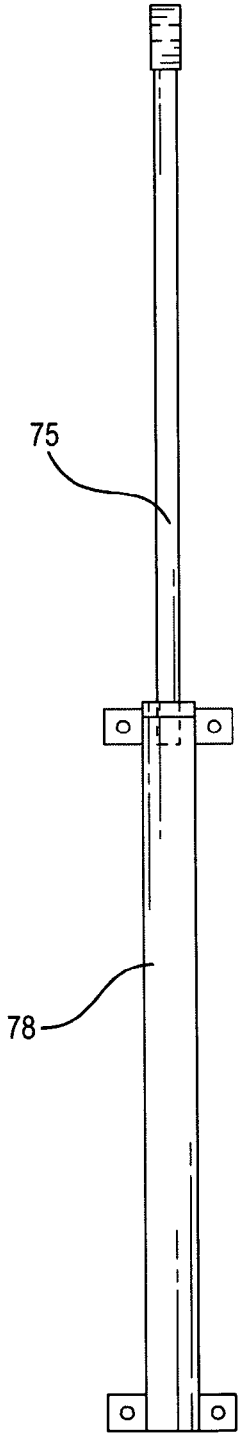
FIG. 5B is a side view showing the apparatus of FIG. 5A extended.
Figure 5C:
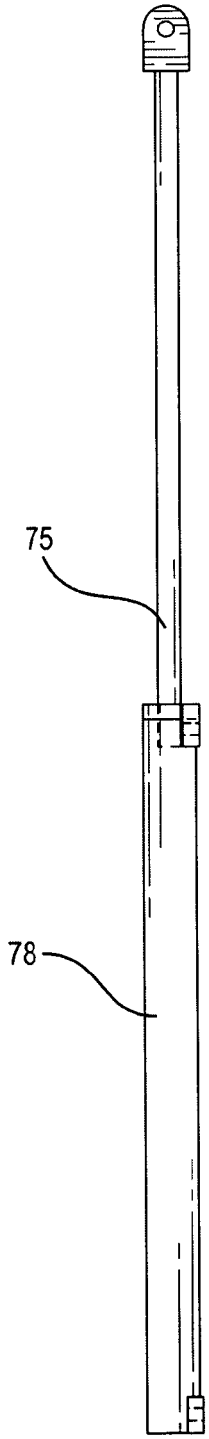
FIG. 5C is a side view showing the apparatus of FIG. 5A extended.

FIGS. 5A-5C illustrate various positions for the hydraulic ram apparatus 78.

Figure 6A:
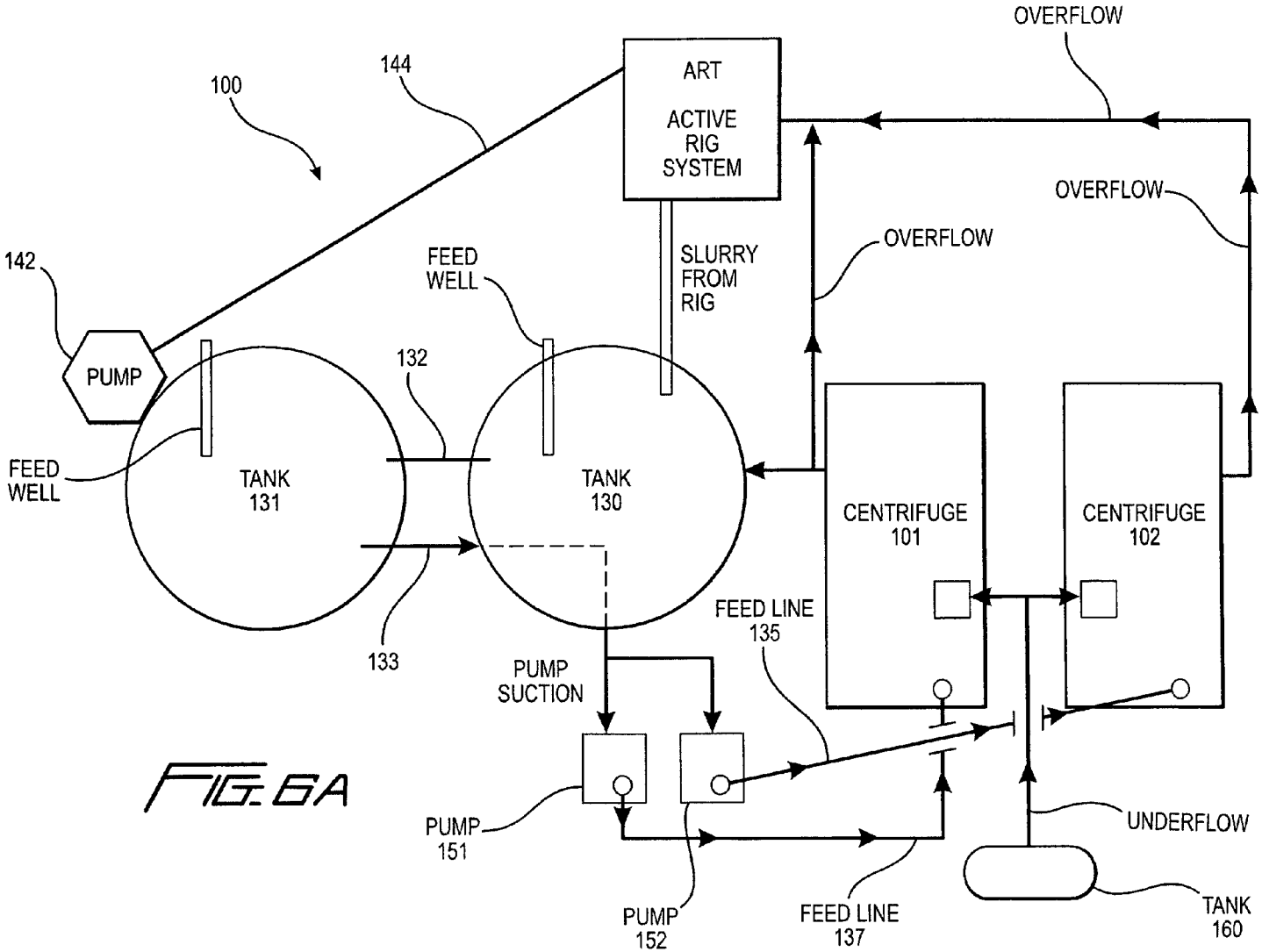
FIG. 6A is a schematic view of a system according to the present invention.

FIG. 6A shows schematically a system 100 like the system of FIG. 1A. Two centrifuges 101, 102 are like the centrifuge 50; and tanks 130, 131 correspond, respectively, to the tanks 30, 31. A tank 160 corresponds to the tank 60; a pump 142 corresponds to the pump 42; and an active rig system ART corresponds to the active rig system ARS.

As shown in FIG. 6A the system 100 is useful, e.g. in typical drilling operations. A slurry from the active rig system ART fed to the tank 130 with solids material therein is pumped by a pump 151 to the centrifuge 101 in a feed line 137. The underflow (with solids and drilled solids) from the centrifuge 101 is gravity fed to the tank 160. The overflow from the centrifuge 101 is gravity fed to the tank 130 or back to the system ART. From the tank 130, a pump 152 pumps fluid with solids in a feed line 135 to the centrifuge 102. Overflow from the centrifuge 102 flows by gravity to the active rig system ART or to the tank 130. Underflow from the centrifuge 102 flows to the tank 160.

The tank 130 can overflow to the tank 131 via a baffle 132.

The centrifuge overflows of centrifuges 101 and 102 are primarily cleaned fluid and the underflows contain drill solids for return to the tank 160. Pump suction from the pump 151 and/or the pump 152 is applied to the line 133 to pump from both tanks 130 and 131.

Relatively clean fluid is pumped by the pump 142 in a line 144 to the active rig system ART.

Figure 6B:
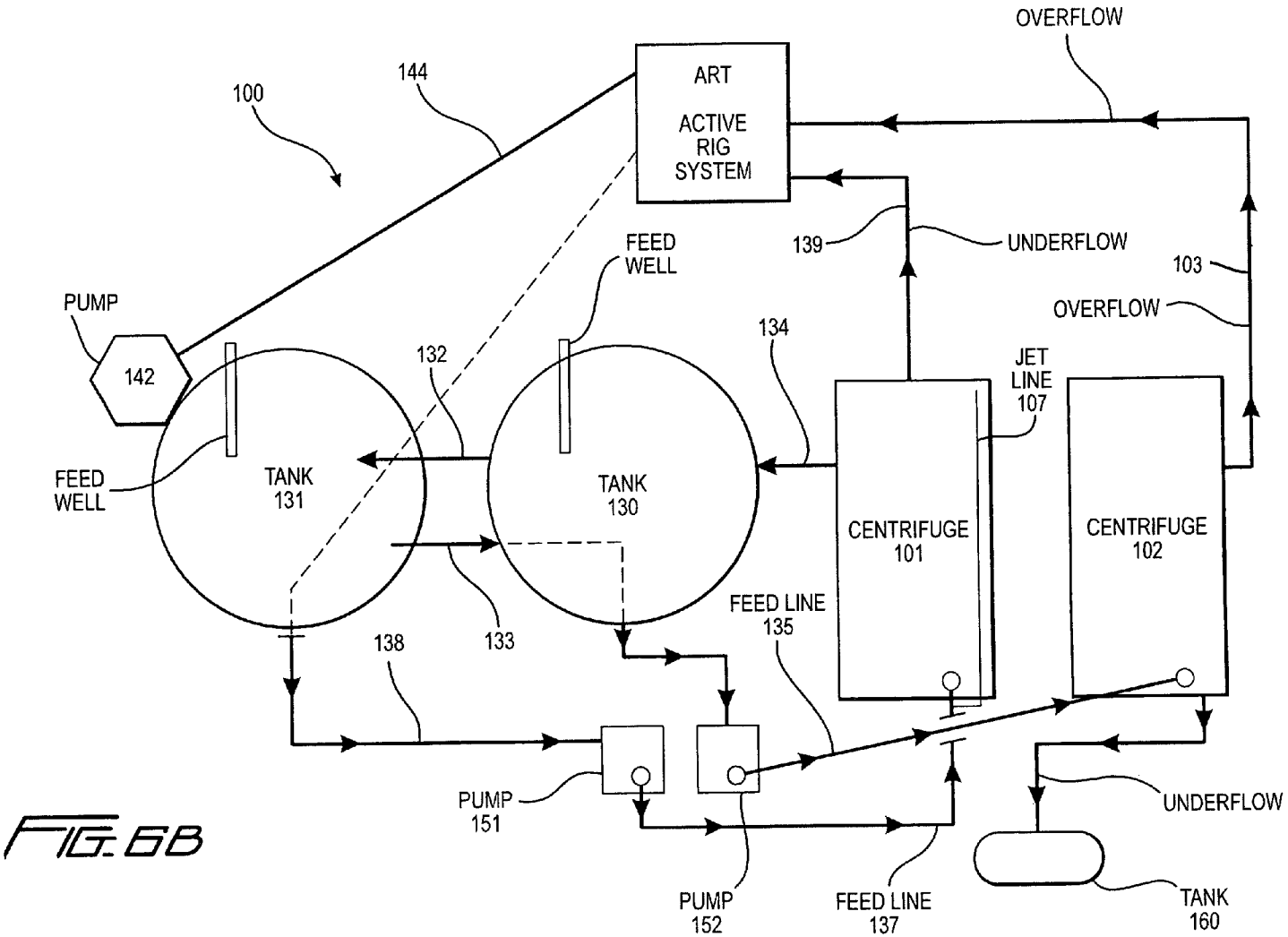
FIG. 6B is a schematic view of a system according to the present invention.
Figure 6C:
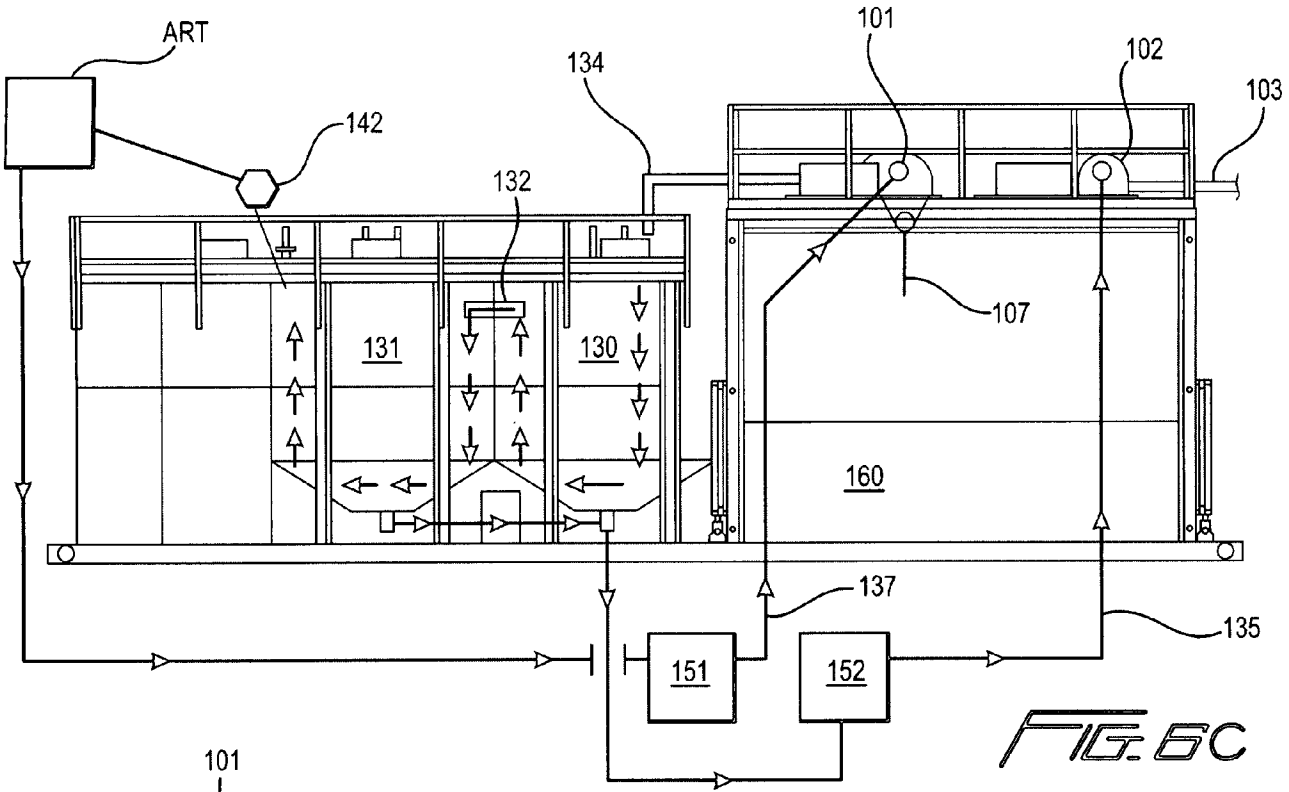
FIG. 6C is a side schematic view of the system of FIG. 6B.

In one particular aspect the system 100 is used for barite recovery, as shown in FIGS. 6B and 6C. A slurry from the active rig system ART with barite material therein is pumped from a line 138 by the pump 151 in the line 137 to the centrifuge 101. The underflow (primarily barite and/or drilled solids) is jetted by a line 137 and is gravity fed to the system ART in a line 139. The overflow from the centrifuge 101 is gravity fed in the line 134 to the tank 130. Material from the tank 130 is pumped by the pump 152 in the line 135 to the centrifuge 102. Overflow from the centrifuge 102 flows by gravity to the system ART. Underflow from the centrifuge 102 flows to the tank 160.

Figure 6D:
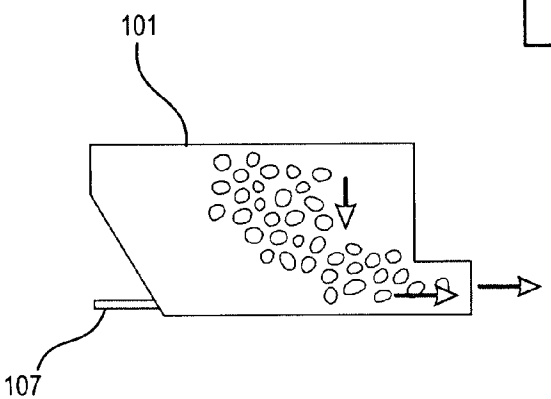
FIG. 6D is a side cross-section view of part of the system of FIG. 6B.

Centrifuge 101 underflow contains recoverable barite which is returnable to the active rig system ART. The jet line 107 is fed by the line 137. The jet line 107 is a line with pressurized fluid for inhibiting plugging by barite and for moving the barite to the system ART. In one aspect fluid from the line 137 is oil based fluid at about 25 psi. FIG. 6D illustrates the exit of barite solid particles from the centrifuge 101. This barite flows by gravity or is pumped.

Figure 7:
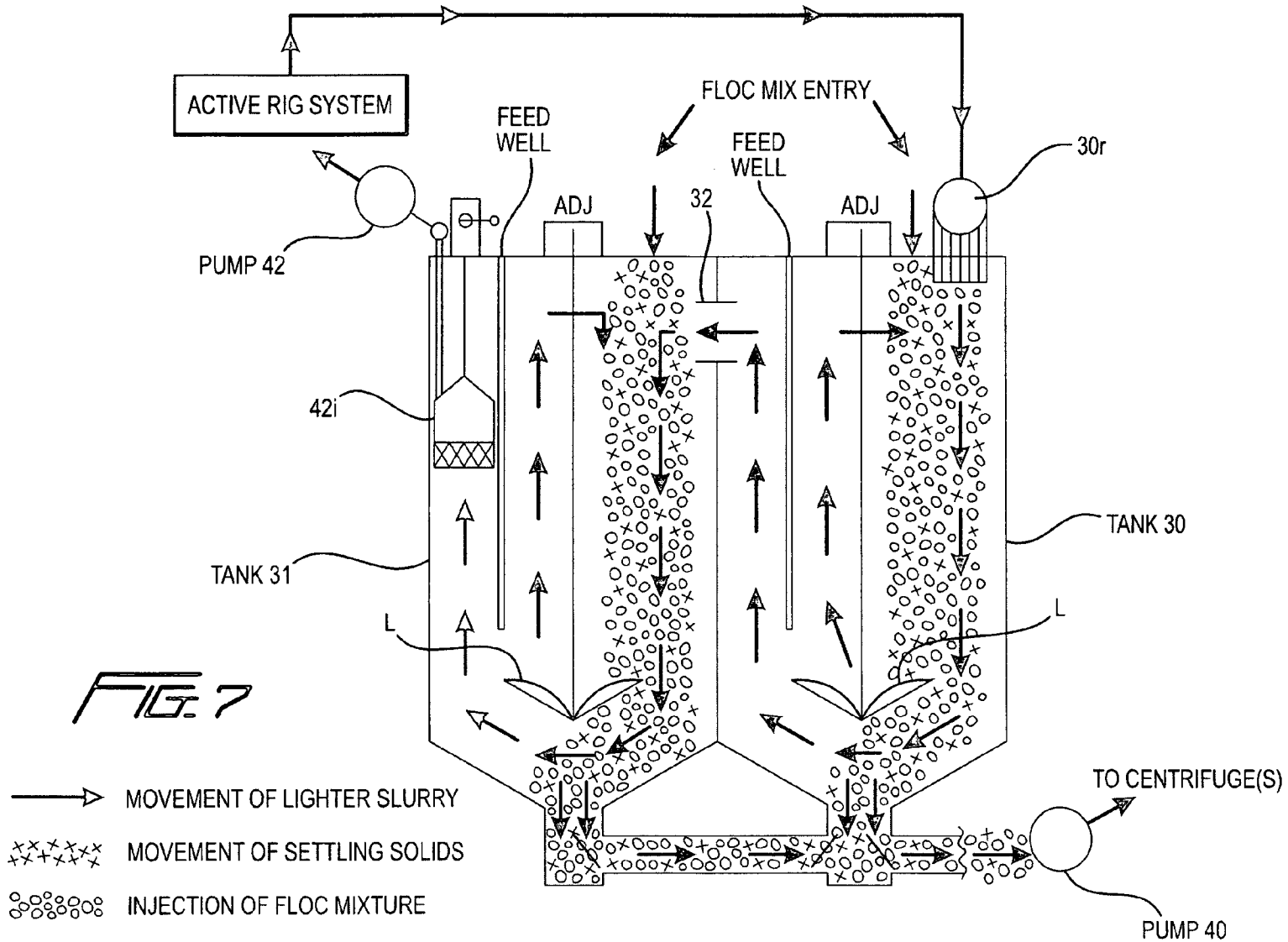
FIG. 7 is a side schematic view of a system according to the present invention.

FIG. 7 shows one particular embodiment for the tanks 30, 31 and associated pumps 40 and 42. Slurry from the active rig system is introduced into the tank 30 via an inlet 30*r*. The slurry contains drilling fluid, drill solids or drilling solids (desirable solids added to drilling fluid), drilled solids (e.g. drilled cuttings) and debris. The mixture from the tank 21 is fed to the tanks 30, 31 ("FLOC MIX ENTRY"). The pump 40 pumps a mixture of solids and some other components to the centrifuge(s) 50. The pump 42 pumps water from the tank 31 back to the active rig system ARS. The pump 42 is connected to, and in fluid communication with, the feed well of the tank 31. Water pumped by the pump 42 comes to it directly from the feed well of the tank 31.

Optionally, agitators ADJ with impellers L agitate the fluid in the tanks.

The present invention, therefore, provides in at least certain embodiments, a system for well fluid treatment, the system being transportable, the system including: a base; a support structure on the base; a brace apparatus connected to the base and to the support structure for bracing the support structure during movement of the system, the brace apparatus releasably secured to the support structure and releasably secured to the base; at least one holding tank on the base for holding well fluid to be treated, the well fluid to be treated from an active rig well fluid system and the well fluid to be treated including solids; centrifuge apparatus for centrifuging a mixture of well fluid and solids from the at least one holding tank, producing a reusable component of the well fluid; a first pump apparatus for pumping well fluid and solids from the at least one holding tank to the centrifuge apparatus; and a centrifuge support on the base for supporting the centrifuge apparatus. Such a system may have one or some, in any possible combination, of the following: a mixing tank for mixing materials in aqueous solution for introduction to well fluid in the at least one holding tank, and a second pump apparatus for pumping materials in aqueous solution from the mixing tank to the at least one holding tank; wherein the materials in aqueous solution include flocculant and coagulant; raising apparatus connected to the centrifuge support for raising the centrifuge support and the centrifuge apparatus to a desired height; wherein the raising apparatus raises the centrifuge support up vertically; wherein the raising apparatus includes hydraulically powered piston apparatus for raising the centrifuge support; wherein the at least one holding tank has a conical bottom for facilitating solids concentration and movement; the at least one holding tank is two holding tanks including a first holding tank, a second holding tank adjacent the first holding tank, the second pump apparatus pumping the materials in aqueous solution into the first holding tank, and the first holding tank receiving the well fluid to be treated; water flow apparatus via which water is flowable from the second holding tank to the first holding tank; a third pump apparatus for pumping water from the first holding tank; wherein the third pump apparatus pumps the water to one of the active rig well fluid system and storage; wherein the well fluid to be treated includes drilled solids and the centrifuge apparatus produces an overflow of cleaned well fluid for feed back to the active rig well fluid system, and the centrifuge apparatus produces an underflow of drilled solids; the centrifuge apparatus includes a plurality of centrifuges for processing fluid with solids from the at least one holding tank; wherein the well fluid to be treated contains recoverable barite solids and the centrifuge apparatus produces an underflow with recovered barite solids for feed to the active rig well fluid system, and the centrifuge apparatus produces an overflow for feed to the at lest one holding tank; and/or a jet line for providing fluid under pressure to the recovered barite solids to facilitate flow of the recovered barite solids to the active rig well fluid system.

The present invention, therefore, provides in at least certain embodiments, a system for well fluid treatment, the system being transportable, the system including: a base; a support structure on the base; a brace apparatus connected to the base and to the support structure for bracing the support structure during movement of the system, the brace apparatus releasably secured to the support structure and releasably secured to the base; at least one holding tank on the base for holding well fluid to be treated, from an active rig well fluid system and the well fluid to be treated including drilling solids and drilled solids; centrifuge apparatus for centrifuging a mixture of well fluid and solids from the at least one holding tank, producing reusable drilling solids; a first pump apparatus for pumping well fluid and drilling solids from the at least one holding tank to the centrifuge apparatus; a centrifuge support on the base for supporting the centrifuge apparatus; a mixing tank for mixing materials in aqueous solution for introduction to well fluid in the at least one holding tank; a second pump apparatus for pumping materials in aqueous solution from the mixing tank to the at least one holding tank; and wherein the materials in aqueous solution include flocculant and coagulant.

The present invention, therefore, provides in at least certain embodiments, a method for treating well fluid with drilling fluid, drilled solids, and drilling solids therein, the well fluid from an active rig well fluid system, the method including providing well fluid to a well fluid treatment system from an active rig well fluid system, the well fluid treatment system as any described or claim herein according to the present invention, and producing reusable material with the centrifuge apparatus of the well treatment system. Such a method may have one or some, in any possible combination, of the following: the centrifuge apparatus producing a stream of reusable drilling solids, and returning the stream of reusable drilling solids to the active rig well fluid system; and/or the centrifuge apparatus producing a stream of reusable fluid, and returning the stream of reusable fluid to the active rig well fluid system.

The present invention, therefore, provides in at least certain embodiments, a method for transporting a well fluid treatment system, the well fluid treatment system including well fluid treatment apparatuses secured to a support structure, the support structure secured to a base, the method including connecting bracing apparatus releasably to the base and to the support structure to brace the well fluid treatment system during movement of the well fluid treatment system.

The present invention, therefore, provides in at least certain embodiments, a method for moving a centrifuge support with centrifuge apparatus thereon of a well fluid treatment system, the method including raising with raising apparatus the centrifuge support with centrifuge apparatus thereon, said raising being raising the centrifuge support up vertically.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A transportable system for well fluid treatment, comprising:

a base, a support structure on the base, a removable brace apparatus that is adapted for bracing the support structure during movement of the system, wherein the removable brace apparatus is adapted to be releasably secured to the support structure and to the base during movement of the system, at least one holding tank on the base that is adapted for receiving a mixture of well fluid and solids to be treated from an active rig well fluid system, a centrifuge apparatus that is adapted for centrifuging the mixture of well fluid and solids from the at least one holding tank to produce a reusable component of the well fluid, a first pump apparatus that is adapted for pumping well fluid and solids from the at least one holding tank to the centrifuge apparatus, and a centrifuge support on the base that is adapted for supporting the centrifuge apparatus.

2. The system of claim 1 further comprising:

a mixing tank comprising a mixing apparatus that is adapted for mixing materials in an aqueous solution for introduction to well fluid in the at least one holding tank, and a second pump apparatus that is adapted for pumping the materials in aqueous solution from the mixing tank to the at least one holding tank.

3. The system of claim 2 wherein the mixing tank comprising the mixing apparatus is adapted for mixing and the second pump apparatus is adapted for pumping materials in an aqueous solution comprising at least one of a flocculant and a coagulant.

4. The system of claim 2 wherein the at least one holding tank comprises a first holding tank, and a second holding tank adjacent the first holding tank, wherein the second pump apparatus is adapted for pumping the materials in aqueous solution into the first holding tank, and the first holding tank is adapted for receiving the mixture of well fluid and solids to be treated.

5. The system of claim 4 further comprising a water flow control apparatus that is adapted to control a flow of water from the second holding tank to the first holding tank.

6. The system of claim 5 further comprising a third pump apparatus that is adapted for pumping water from the first holding tank.

7. The system of claim 6 wherein the third pump apparatus is adapted for pumping the water from the first holding tank to one of the active rig well fluid system and storage.

8. The system of claim 1 further comprising a raising apparatus connected to the centrifuge support, wherein the raising apparatus is adapted for raising the centrifuge support and the centrifuge apparatus to a desired height.

9. The system of claim 8 wherein the raising apparatus is further adapted for vertically raising the centrifuge support.

10. The system of claim 8 wherein the raising apparatus comprises a hydraulically powered piston apparatus that is adapted for raising the centrifuge support.

11. The system of claim 1 wherein the at least one holding tank has a conical bottom that is adapted for facilitating solids concentration and movement.

12. The system of claim 1 wherein the centrifuge apparatus is adapted for producing an overflow of cleaned well fluid for feed back to the active rig well fluid system and an underflow of drilled solids.

13. The system of claim 1 wherein the centrifuge apparatus comprises a plurality of centrifuges that are each adapted for processing the mixture of well fluid and solids from the at least one holding tank.

14. The system of claim 1 wherein the centrifuge apparatus is adapted for producing an underflow comprising recovered barite solids for feed to the active rig well fluid system and an overflow for feed to the at least one holding tank.

15. The system of claim 14 further comprising a jet line that is adapted for providing fluid under pressure to the recovered barite solids to facilitate flow of the recovered barite solids to the active rig well fluid system.

16. A transportable system for well fluid treatment, comprising:

a base, a support structure on the base, a removable brace apparatus that is adapted for bracing the support structure during movement of the system, wherein the removable brace apparatus is adapted to be releasably secured to the support structure and to the base during movement of the system, at least one holding tank on the base that is adapted for receiving a mixture of well fluid and drilling solids to be treated from an active rig well fluid system, a centrifuge apparatus that is adapted for centrifuging the mixture of well fluid and solids from the at least one holding tank to produce reusable drilling solids, a first pump apparatus that is adapted for pumping well fluid and drilling solids from the at least one holding tank to the centrifuge apparatus, a centrifuge support on the base that is adapted for supporting the centrifuge apparatus, a mixing tank comprising a mixing apparatus that is adapted for mixing materials in an aqueous solution comprising at least one of a flocculant and a coagulant for introduction to well fluid in the at least one holding tank, and a second pump apparatus that is adapted for pumping the materials in said aqueous solution from the mixing tank to the at least one holding tank.

* * * * *